US008898825B2

(12) United States Patent
Sundberg et al.

(10) Patent No.: US 8,898,825 B2
(45) Date of Patent: Dec. 2, 2014

(54) BABY BATH SEAT WITH HANGER

(75) Inventors: Brian C. Sundberg, Chester, NH (US); Jorge Tomas, Wrentham, MA (US); J. Michael Treen, Jamaica Plain, MA (US)

(73) Assignee: Cosco Management, Inc., Wilmington, DE (US)

( * ) Notice: Subject to any disclaimer, the term of this patent is extended or adjusted under 35 U.S.C. 154(b) by 759 days.

(21) Appl. No.: 11/003,639

(22) Filed: Dec. 3, 2004
(Under 37 CFR 1.47)

(65) Prior Publication Data

US 2005/0229302 A1 Oct. 20, 2005

Related U.S. Application Data

(63) Continuation of application No. 10/469,412, filed as application No. PCT/US02/20816 on Jul. 1, 2002, now Pat. No. 7,058,995.

(60) Provisional application No. 60/302,718, filed on Jul. 3, 2001.

(51) Int. Cl.

| | |
|---|---|
| ***A47K 3/024*** | (2006.01) |
| ***A47K 3/12*** | (2006.01) |
| ***A47K 3/034*** | (2006.01) |

(52) U.S. Cl.

CPC ..... *A47K 3/127* (2013.01); *A47K 3/034* (2013.01)

USPC ..... 4/572.1

(58) Field of Classification Search

USPC ..... 4/572.1, 579, 560.1, 573.1, 578.1

See application file for complete search history.

(56) References Cited

U.S. PATENT DOCUMENTS

| | | | | |
|---|---|---|---|---|
| 337,001 | A | 3/1886 | Kelley | |
| 362,969 | A | 5/1887 | Jacobus | |
| 488,011 | A | 12/1892 | Keene | |
| 602,125 | A | 4/1898 | Burrows | |
| 642,168 | A | 1/1900 | Smith | |
| 1,245,660 | A | 11/1917 | Behm | |
| 1,428,039 | A | 9/1922 | Kratz | |
| 2,142,263 | A | 1/1939 | Bentz | |
| 2,142,434 | A | 1/1939 | Bentz | |
| 2,177,998 | A | 10/1939 | Schuette | 4/572.1 |
| 2,481,725 | A | 9/1949 | Culley et al. | |
| 2,728,377 | A | 12/1955 | Thompson | |

(Continued)

FOREIGN PATENT DOCUMENTS

| | | |
|---|---|---|
| GB | 2 320 187 | 6/1998 |
| JP | 02198529 | 8/1980 |

(Continued)

OTHER PUBLICATIONS

Combined Search and Examination Report for GB0428399.0, Jan. 25, 2005, 2 pages.

(Continued)

*Primary Examiner* — Lori Baker
(74) *Attorney, Agent, or Firm* — Barnes & Thornburg LLP

(57) ABSTRACT

A baby bath seat assembly includes a support member having a mounting bracket that clamps onto a tub wall and carrying a support that extends downwardly into the tub. The support carries a base on which the seat is mounted to turn through approximately 180°, and a detent mechanism releasably locks the seat in any selected position.

11 Claims, 4 Drawing Sheets

(56) References Cited

U.S. PATENT DOCUMENTS

| | | | | | |
|---|---|---|---|---|---|
| 2,765,475 | A | | 10/1956 | Nolane | |
| 3,022,518 | A | | 2/1962 | Hayden | |
| 3,289,217 | A | | 12/1966 | Glover | 4/562.1 |
| 3,422,466 | A | * | 1/1969 | Banoczi | 4/579 X |
| 3,619,823 | A | | 11/1971 | Sackett | |
| 4,356,575 | A | * | 11/1982 | Terry | 4/559 |
| 4,391,006 | A | * | 7/1983 | Smith | 4/579 X |
| 4,472,844 | A | | 9/1984 | Mace | |
| 4,837,871 | A | | 6/1989 | Wheeler | 4/546 |
| 5,033,131 | A | | 7/1991 | Paden | |
| 5,097,542 | A | | 3/1992 | Roesler | |
| D327,777 | S | | 7/1992 | Tepper | |
| 5,158,460 | A | | 10/1992 | Bernstein et al. | |
| 5,588,158 | A | | 12/1996 | Poulson et al. | |
| 5,809,588 | A | | 9/1998 | Angelotti | |
| 6,112,343 | A | | 9/2000 | Dixon | |
| 6,314,592 | B1 | | 11/2001 | Stein | |
| 6,834,400 | B2 | | 12/2004 | Zanardelli et al. | |

FOREIGN PATENT DOCUMENTS

| | | | |
|---|---|---|---|
| JP | 08024152 | | 1/1996 |
| JP | 11123152 | A | 5/1999 |
| JP | 2004081788 | A | 3/2004 |

OTHER PUBLICATIONS

Search Report for GB0428399.0, Jan. 24, 2005, 1 page.

* cited by examiner

BABY BATH SEAT WITH HANGER

CROSS-REFERENCE

This application claims priority under 35 U.S.C. 119(e) to U.S. Provisional Application No. 60/302,718, filed Jul. 3, 2001, which is hereby incorporated by herein by reference. This application is a continuation of U.S. application Ser. No. 10/469,412 having a filing date of Jul. 1, 2002 based upon U.S. application Ser. No. 10/469,412 being a national stage application of International Application PCT/US02/20816, filed on Jul. 1, 2002. U.S. application Ser. No. 10/469,412 is hereby incorporated herein by reference.

FIELD OF THE INVENTION

This invention relates to bath seats for young children and more particularly comprises a new and improved baby's bath seat that attaches to a side wall of the tub and provides a secure seat for a child.

BACKGROUND OF INVENTION

The acceptability of bath seats for use by young children is determined by many major safety considerations, including the stability of the bath seat and the inability of a child seated in the bath seat to either slip off it under the seat restraint or climb out of the seat. Other considerations are the comfort of the child, the accessibility of the child by the caregiver bathing it, and the ease with which the bath seat may be mounted for use in a bath tub.

SUMMARY OF THE INVENTION

The bath seat of the present invention maximizes the safety considerations and at the same time provides comfort for the child, is convenient to use and is easy to attach to and detach from the tub. More particularly, the bath seat assembly of the present invention includes a mounting bracket for attaching the seat assembly to a side wall of the tub by means of a clamp that may be adjusted to fit a wide variety of tub shapes and sizes. The mounting bracket is attached to a support that extends downwardly toward the bottom of the tub and which in turn carries a base for a child's seat. In the preferred embodiment, the seat may be pivoted on the base so that the child in the seat may be thoroughly and conveniently bathed. Moreover, the seat may be releasably locked in several different positions.

DETAILED DESCRIPTION

Figure 1:
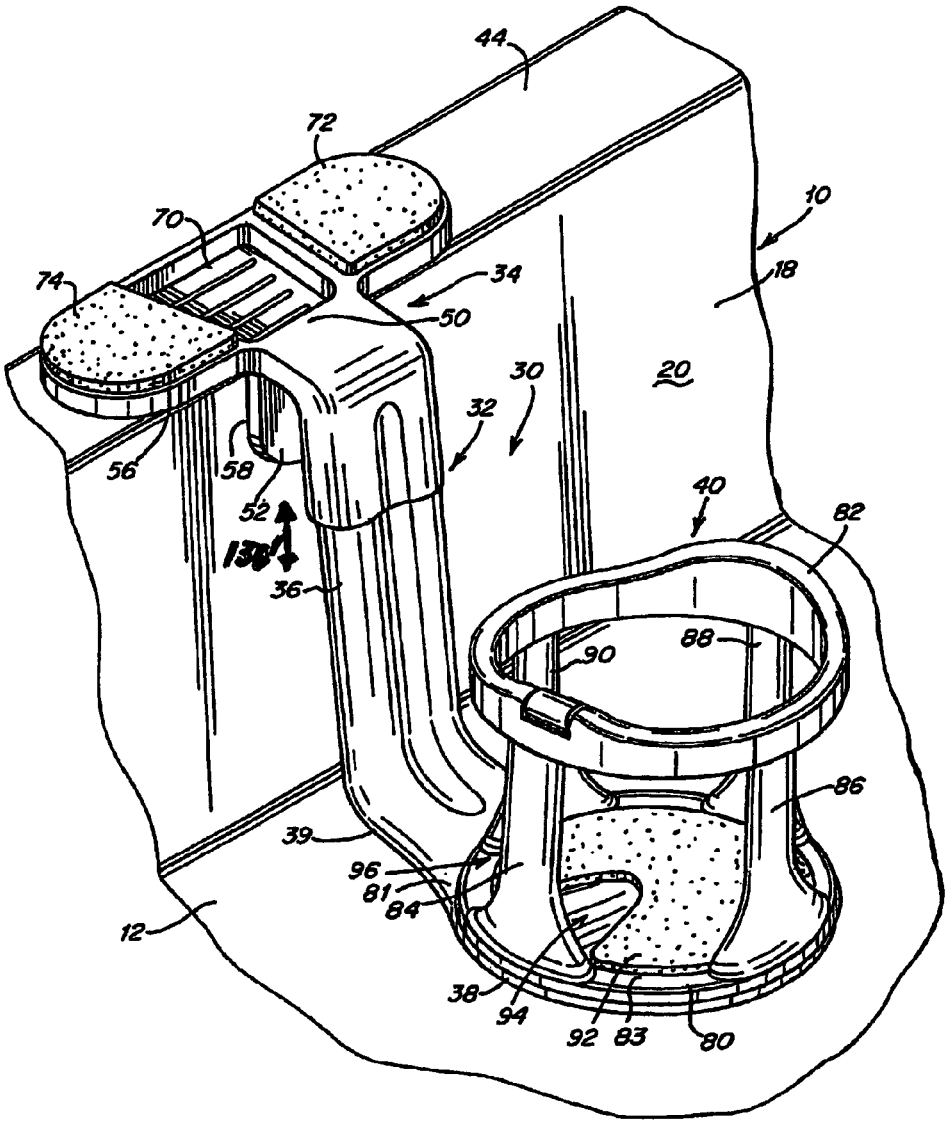
FIG. 1 is a perspective view of one embodiment of a bath seat that embodies this invention.
Figure 2:
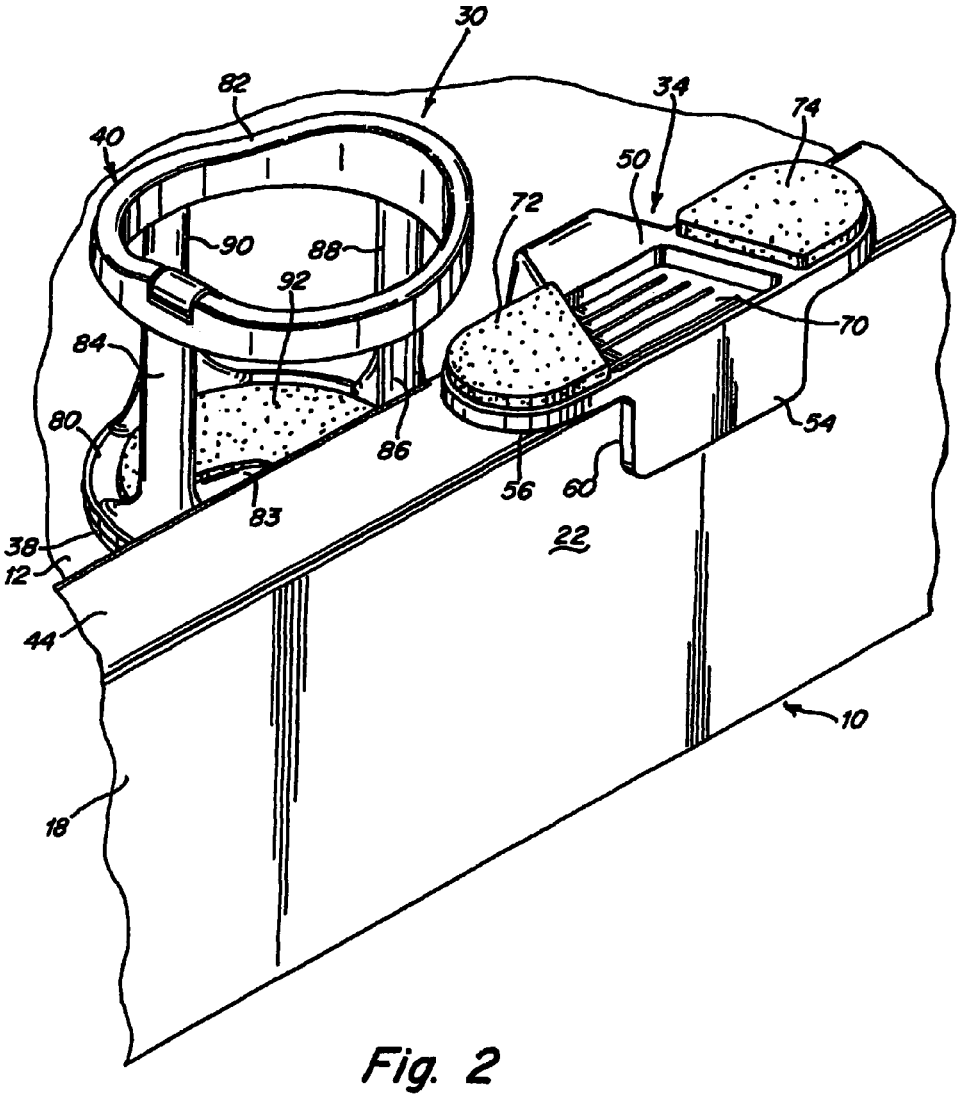
FIG. 2 is a side perspective view of a bath seat viewed from outside the tub and with the seat in an alternative position.

The bath seat of the present invention is shown in FIGS. 1 and 2 mounted in a bath tub 10 that is representative of a great variety of bath tubs now available and with which the seat may be used. The bath tub 10 normally includes a bottom wall 12, end walls (not shown) and side walls 18 (one of which is shown). Conventionally, one end wall either carries or is disposed closely adjacent to the faucet or faucets (not shown) for supplying water to the tub and adjacent a drain (not shown) provided in the bottom wall 12. The tub may be assumed to be disposed with its second side wall against or coincident with a wall of the room in which the tub is placed while the opposite side wall 18 is spaced from the wall so that both its inner and outer faces 20 and 22 are exposed. The tub may of course be free standing or it may have one, neither or both of its end walls coincident with a wall or walls of the room housing the tub and/or both side walls may be fully exposed, that is, spaced from the room walls.

The bath seat assembly 30 shown in FIGS. 1 and 2 includes a support assembly 32 composed of a mounting bracket 34, support 36 and base 38. The base 38 in turn carries the bath seat 40 that also forms part of the bath seat assembly 30. It will be noted in FIGS. 1 and 2 that the mounting bracket 34 of the support assembly 32 spans the upper surface 44 of the tub wall 18 and includes parts that engage the tub wall upper surface 44 as well as the inner and outer tub wall surfaces 20 and 22. In this embodiment the mounting bracket includes a top wall 50, an inner substantially vertical wall 52 and an outer substantially vertical wall 54. The walls 52 and 54 may diverge from one another in a downward direction or be capable of doing so to accommodate the shape of the tub side wall. The inner and outer walls 52 and 54 along with the top wall 50 are intended to firmly engage the upper portion of the tub wall 18 so as to provide a very firm and essentially immovable but releasable connection to the wall 18. For that purpose, the bottom surface 56 of the top wall 50 and the opposed facing surfaces 58 and 60 of the walls 52 and 54 may be integrally formed with or be otherwise provided with a covering layer that will not slip on the smooth tub surface. It is contemplated that the inner and outer walls 52 and 54 of the mounting bracket may be moved with respect to one another so as to vary the gap between them. This will enable the walls to be clamped tightly against the inner and outer surfaces of the side wall of the tub to insure a very tight fit so that the mounting bracket is fixed in position until such time as a responsible person wishes to remove the assembly 30 with the seat 40 after the baby has been removed from it. As an example, and not to be interpreted as a limitation to the scope of the invention, the inner wall 52 may be slidably mounted on the top wall 50 of the mounting bracket, and it may be moved toward and away from the outer wall 54 by a vise-like assembly typically operated by a screw axially fixed on the assembly 30 and engaging a threaded hole in the wall 52 so that rotation of the screw will translationally move the wall 52 on its slide mounting to the top wall and force the two walls 52 and 54 firmly against the inner and outer surfaces 20 and 22 of the tub wall 18. The screw (not shown) connected to the wall 52 may be threaded through a hole in the support 36 causing it to move axially when rotated and move that wall toward or away from the outer wall 54. As yet another alternative, a second outer wall may be rigidly connected to the top wall 50 parallel to and beyond the outer wall 54 and a vise-like screw actuator may thread through the second outer wall and carry the outer wall 54 toward and away from the tub wall 18 and opposite inner wall 52. In yet another embodiment, wall 52 or 54 may be spring loaded toward the other wall by a compression spring disposed, for example, between wall 52 and support 32. The clamping action may be effective whether or not the top wall 50 engages the top of the tub wall 50.

In the embodiment shown in FIGS. 1 and 2, the top wall 50 of the mounting bracket includes a tray 70 formed either as an integral part thereof or fabricated separately and attached to the wall 50. The tray 70 provides a convenient repository for the soap, washcloth, etc. used to bathe the baby. The top wall 50 is also shown to carry a pair of cushions 72 and 74 on which the attendant bathing the baby may rest his/her wrists or arms while leaning over to bathe the baby.

The support 36 that extends downwardly from the mounting bracket 34 may be integrally formed with the bracket or be separately formed and thereafter connected to it. For convenience of storage and travel, the support 36 may be separated from the bracket when the bath seat assembly is not in use. The support 36 may also be expandable or otherwise adjustable in length (see arrow 136 in FIG.1) to accommodate tubs having side walls of different height. For example, it may telescope together and lock in selected lengths to allow the base 38 to rest on the tub bottom wall 12.

The base 38 of the mounting assembly 32 may engage or be disposed above the bottom wall 12 of the tub, and its upper surface 81 provides a platform for the bath seat 40. The base 38 is connected to the support 36 by means of the base extension 39. The bath seat includes a bottom wall 80, preferably contoured on its upper surface 83 to provide a comfortable seat for the baby, and a baby retainer 82 that in the embodiment shown is in the form of a continuous ring that encircles the baby's torso when resting on the seat surface 83. The retainer 82 in the embodiment shown is carried by four legs 84, 86, 88 and 90 connected at their lower and upper ends to the bottom wall 80 and retainer 82 respectively. In the embodiment shown, a cushioning layer 92 is provided on the upper surface 83 of the seat and forms a no-slip surface that will prevent the baby from sliding about on the seat. The function performed by the covering 92 may also be achieved by specially texturing the surface 83 itself. Either technique falls within the scope of this invention.

The post 84 serves as a crotch post disposed between the baby's legs that extend outwardly beyond the edges of the bottom wall 80 through the openings 94 and 96 respectively defined between the posts 84 and 86, and 84 and 90. The openings 94 and 96 as well as the openings between the posts 86 and 88 and between posts 88 and 90 are sufficiently small so as not to allow the torso of a baby to slide through them should both of the baby's legs find their way into the same opening when the child is in the bath seat. Moreover, the shape and spacing of the four posts 84-90 and the diameter of the retainer 82 preferably is such that a baby properly seated in the bath seat with its legs in the openings 94 and 96 will be unable to lift itself upwardly in the bath seat to an erect or semi-erect position that would allow it to free itself from the bath seat and climb over the top of the retainer 82. While the retainer ring 82 in this embodiment is shown supported by four legs on the bottom wall 80, it is to be understood that a different number of legs, for example three legs, may be employed but the openings between them should be too small to allow a baby's body to slide through.

It is contemplated that the bath seat may be moved circumferentially from a position wherein the child seated properly in it can be turned to face either end of the tub or in one or more or even an infinite number of positions between those two extremes. As the seat is turned, the child preferably faces away from the mounting bracket 34 and support 36, and the tuning motion includes approximately 90 degrees in either direction from the position wherein the baby faces away from the bracket 34. Note the contrasting positions of the seat as illustrated in FIGS. 1 and 2.

In accordance with one aspect of the invention, the entire bath seat 40 is rotatable through approximately 180 degrees on the base 38 of the mounting assembly 30 by means of an arrangement such as shown in U.S. Pat. Nos. 5,010,616 and 5,158,460 assigned to the assignee of the present invention and incorporated herein by reference. The '460 patent is a continuation of the '616 patent. The relevant portions of their specifications and drawings are contained herein (see the following paragraphs and FIGS. 3-6).

Figure 3:
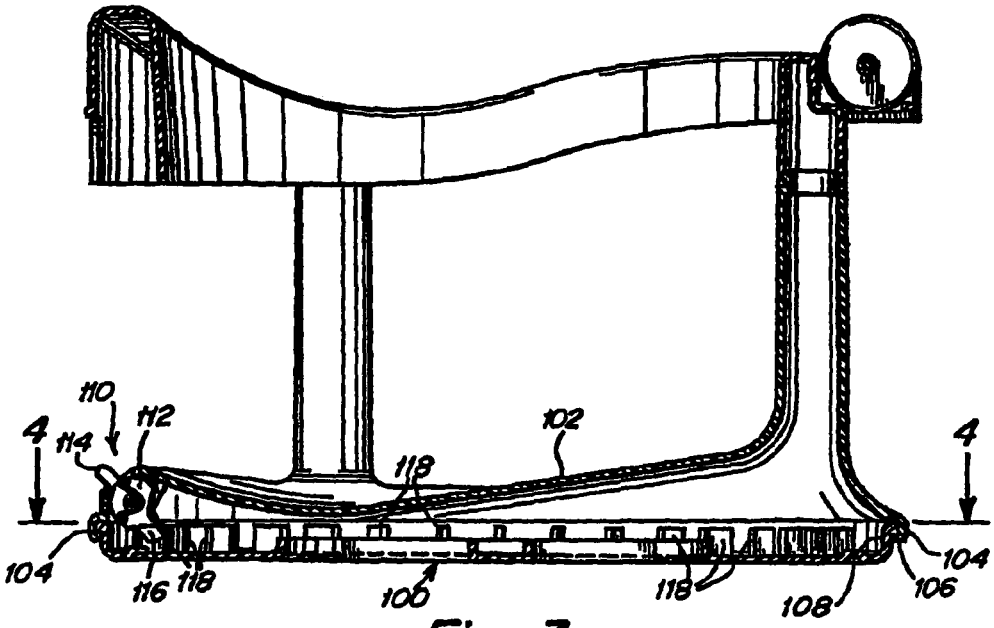
FIG. 3 is a fragmentary cross-sectional view of a bath seat showing one embodiment of a rotatable support and lock for the bath seat.
Figure 4:
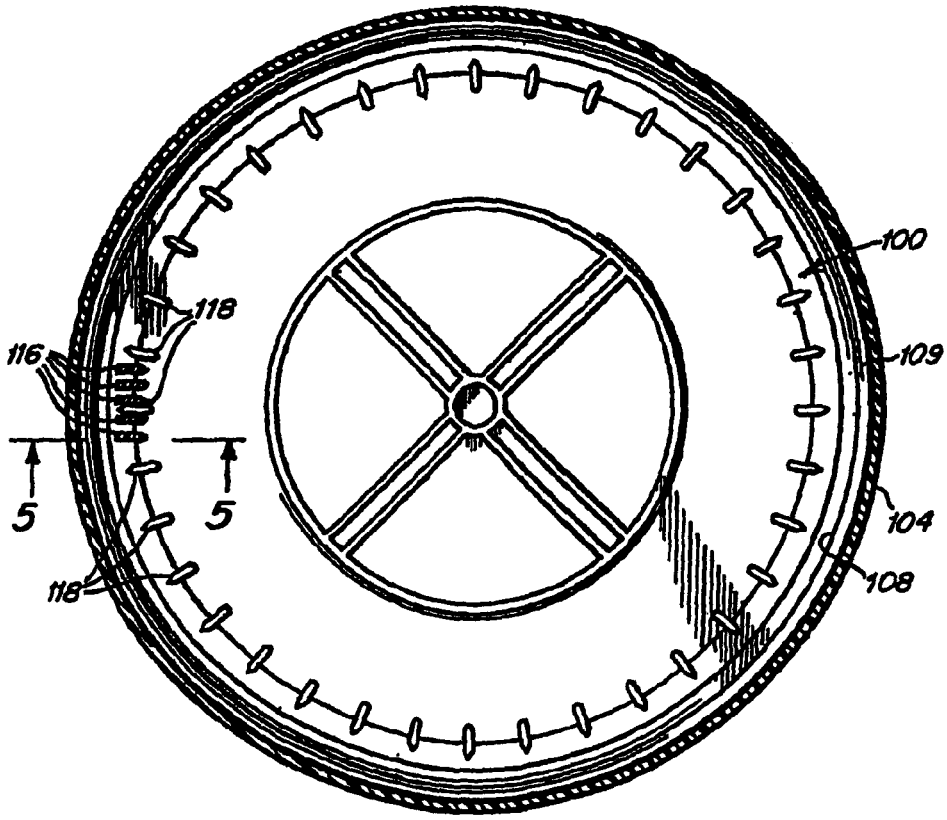
FIG. 4 is a cross-sectional view of the base of the seat taken along section line 4-4 of FIG. 3.
Figure 5:
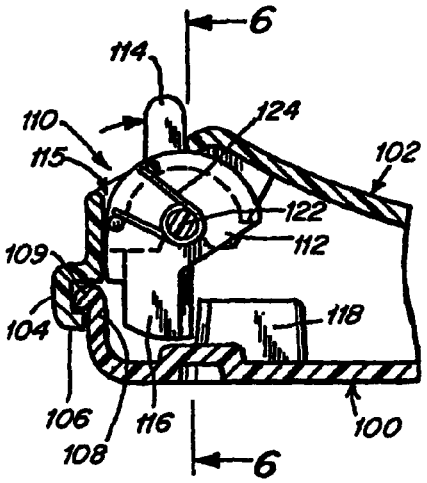
FIG. 5 is a fragmentary cross-sectional view taken along section line 5-5 of FIG. 4.

In FIGS. 3-6 the base. of the assembly is shown at 100 and the contoured seat at 102. The seat 102 has a C-shaped rim 104 with a lower lip 106. The rim 104 mates with the peripheral flange 108 on the base 100 by virtue of a snap fit over the bead 109 of lip 108 as shown in FIG. 5 so as to allow relative rotational movement of the seat 102 and base 100, and retain them in assembled relationship.

Figure 6:
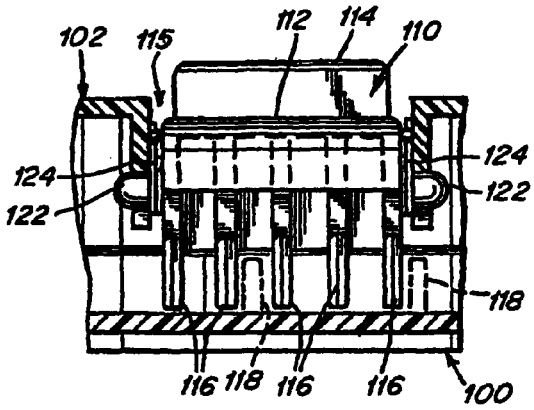
FIG. 6 is a fragmentary cross-sectional view taken along section line 6-6 of FIG. 5.

A detent mechanism 110 serves as a lock to hold the seat in any selected angular position with respect to the base 100, and unlocked it permits rotational motion. The detent mechanism 110 includes a locking member 112 with an operating handle 114 that extends through an opening 115 in the periphery of the seat 102. The locking member 112 carries a plurality of teeth 116 that are sized to engage one or more of the lugs 118 arranged in a circular array about the base 100. When engaged as shown in FIGS. 3 and 4, the seat cannot turn on the base but rather is held in a fixed position. The locking member is moved by the handle 114 between the operative position of FIGS. 3 and 4 to prevent rotation of the seat and an inactive position as shown in FIGS. 5 and 6 wherein the teeth 116 and lugs 118 are disengaged to permit rotation. The rotation of the locking member 112 on its stub shafts 122 is limited by the length of the slot 115 in the periphery of the seat 102 through which the handle 114 extends. A torsion spring or springs 124 may be provided on the shaft or shafts 122 to bias the locking member 112 to its operative position of FIGS. 3 and 4 and require the handle to be held in the position of FIGS. 5 and 6 while the seat 102 is to be turned on the base 100.

If motion of the bath seat is to be limited to less than 360 degrees, for example, to approximately 180 degrees, the lugs provided in the base 38 of the embodiment of FIGS. 1 and 2 need extend only over approximately 180 degrees of the base rather than around the full circumference thereof as do the lugs 118 in FIG. 4. The detent or its corresponding part in the embodiment of FIGS. 1 and 2 may be mounted on the seat 80 at a location that will not interfere with the baby in the seat. A handle such as shown at 114 in FIGS. 3 and 5 may be provided for operating the knob. To further limit the travel to approximately 180 degrees or to the circumferential distance deemed preferable, stops may be provided at the ends of the arcuate row of lugs 114 so as to prohibit movement of the detent beyond the ends of the row of lugs, and the detent is moved to the operative position wherein its teeth engage the lugs to lock the seat in position.

It should be appreciated that many different arrangements may be employed in accordance with other aspects of this invention to limit the rotation of the bath seat on the base and fix it in any selected position. A wide variety of adjustable connectors operatively associated with the seat and case that will securely but releasably lock the two together and permit the person bathing the baby to move the seat to different positions to facilitate bathing the baby or young child may be acceptable.

In accordance with another aspect of the invention, the mounting assembly 30 may be molded of a suitable plastic material or it may be made with any other material that provides comfort to the baby and possesses sufficient strength and rigidity to serve its intended function.

Having described this invention in detail, those skilled in the art will appreciate that numerous modifications may be made of this invention without departing from the spirit of the invention. Therefore, it is not intended that the breadth of the invention be limited to the specific embodiments illustrated and described. Rather, the scope of the invention is to be determined by appended claims and their equivalents.

What is claimed is:

1. A child bath seat assembly comprising a mounting member for attachment to the rim of a bath tub in which a child seat is to be located, a telescoping support that extends downwardly from the mounting member into the tub toward the bottom thereof, a child seat having a child seat surface, the telescoping support being adjustable to provide the child seat to rest on the bottom of the tub, and a child retainer extending upwardly from and disposed above the child seat surface and at least partially surrounding the torso of a child in the seat.

2. A child bath seat as defined in claim 1 wherein the mounting member has a top wall for spanning the top of the tub wall.

3. A child bath seat as defined in claim 1 wherein the retainer is a continuous ring, and a leg opening is provided between the child seat surface and the ring for allowing a child's legs to extend outwardly beyond the child seat.

4. A child bath seat as defined in claim 3 wherein a crotch post extends between the supporting surface and ring at the leg opening for preventing a child from sliding off the child seat through the opening.

5. A child bath seat as described in claim 1 wherein the child seat is moveable with respect to the support whereby the child may be moved to face different positions in the tub thereby facilitating bathing of the child.

6. A child bath seat as described in claim 5 wherein the child seat is moveable with respect to the support to turn the child seat to face either end of the tub.

7. A child bath seat as described in claim 5 wherein the child seat is moveable with respect to the support by rotating the child seat with respect to the support.

8. A child bath seat assembly comprising a mounting member for attachment to an upper surface of a side wall of a bath tub in which a child seat is to be located, a telescoping support extending downwardly from the mounting member into the tub toward the bottom thereof, a child seat having a child seat surface, the telescoping support being adjustable to provide the child seat to rest on the bottom of the tub, and a child retainer extending upwardly from and disposed above the child seat surface and at least partially surrounding the torso of a child in the seat.

9. A child bath seat assembly as described in claim 8 wherein the mounting member has a top wall for spanning the top of the tub wall.

10. A child bath seat assembly as described in claim 9 wherein the mounting member top wall includes cushions located so that an attendant washing the baby may rest the attendant's arms.

11. A child bath seat assembly as described in claim 10 wherein the mounting member top wall includes a tray with a repository for soap.

* * * * *